US005197603A

United States Patent [19]

Lundberg

[11] Patent Number: 5,197,603

[45] Date of Patent: Mar. 30, 1993

[54] DECORATIVE BASKET-TYPE STORAGE UNIT

[76] Inventor: Larry E. Lundberg, 1018-138 E. La Habra Blvd., La Habra, Calif. 90631

[21] Appl. No.: 917,307

[22] Filed: Jul. 23, 1992

Related U.S. Application Data

[63] Continuation of Ser. No. 692,947, Apr. 29, 1991.

[51] Int. Cl.[5] ..... B65D 71/00

[52] U.S. Cl. ..... 206/570; 206/44 K; 206/457; 206/486

[58] Field of Search ..... 206/803, 44 K, 457, 206/486, 570; 217/122

[56] References Cited

U.S. PATENT DOCUMENTS

| | | | |
|---|---|---|---|
| 2,461,177 | 2/1949 | Prestien | 206/457 |
| 3,507,312 | 4/1970 | Peterson | 206/44 K |
| 3,647,102 | 3/1972 | Cooley | 206/423 |
| 3,984,941 | 10/1976 | Chetta, Jr. | 220/334 |
| 4,513,866 | 4/1985 | Thomas | 206/570 |
| 4,601,403 | 7/1986 | Pollitz | 220/23 |
| 5,011,034 | 4/1991 | Abel | 206/457 |

*Primary Examiner*—Jimmy G. Foster
*Assistant Examiner*—Thomas P. Hilliard
*Attorney, Agent, or Firm*—G. Donald Weber, Jr.

[57] ABSTRACT

A storage unit comprising a decorative component which is placed into a basket or similar receptacle on top of a stored package or component wherein the stored component is readily accessible and available without being obtrusive.

3 Claims, 1 Drawing Sheet

DECORATIVE BASKET-TYPE STORAGE UNIT

This is a continuation of application Ser. No. 07/692,947, filed Apr. 29, 1991.

BACKGROUND

1. Field of the Invention

This invention is directed to decorative storage units, in general, and to such decorative storage units which unobtrusively store essential or emergency items, in particular.

2. Prior Art

There are many known applications or utilizations of emergency equipment packages. These packages can be used to provide containers for a number of components such as medical supplies, first aid kits, food components or the like. These storage packages are frequently maintained in many offices and/or households as emergency supplies in case of fires, earthquake, insurrection or the like. These components frequently include medical supplies, small food items and any other emergency items of this nature.

However, in the past these emergency packages have been purely functional and have been created of less than designer-type materials or components. As a result, these items have tended to be stored away or stowed out of sight. At a minimum, this means that the package is placed in a cupboard or closet. More likely, the packages tend to be stored in a basement, attic, garage or some other area which is inaccessible during an emergency situation.

In the past, the aesthetics of such a package has not been considered to be of any significance. Consequently, the package has been hidden away. Inasmuch as the package is stored "out of sight", it also tends to become "out of mind". Thus, the package is forgotten and the whereabouts thereof is not readily recalled during a time of emergency. Thus, the utilitarian value of the package is much diminished because it is not easily and/or readily locatable or at hand in times of emergency.

In addition, there are many known types of decorative devices which tend to be displayed in offices or homes purely for decorative purposes. Many of these decorative items have little or no functional use. However, because of being decoratively pleasing, these components do tend to be placed "in plain sight" and, as well, in areas which are easily and readily accessible to the occupants or residents of the premises.

It is, therefore, a highly desirable object of the instant invention to combine these prior art devices and teachings to implement a new and useful result.

SUMMARY OF THE INSTANT INVENTION

A package of emergency materials such as medical supplies or the like is provided. The package is easily accessible and yet adequately protected by means of an outer covering or container.

The container, per se, may include access means such as straps, handles or the like which improve the accessibility and utilization capability thereof.

The package (which includes the container, unless otherwise noted) is placed in a suitable receptacle which has the form of a decorative and/or utilitarian device. A typical such receptacle is a basket. A typical basket is formed of woven bamboo or other reed-type material.

A suitable decorative item is placed on top of the emergency supply package within the receptacle. A typical decorative item is a floral arrangement which utilizes artificial flowers or the like embedded in a suitable base such as styrofoam or the like. When the unit is assembled, the package of emergency materials is concealed within the receptacle and covered by the decorative item. The receptacle, with the decorative item, is then easily displayed in virtually any environment. Moreover, because of being an aesthetically pleasing device, it can be readily at wherein the emergency package is easily accessed by a person during an emergency situation.

DESCRIPTION OF THE PREFERRED EMBODIMENT

Figure 1:
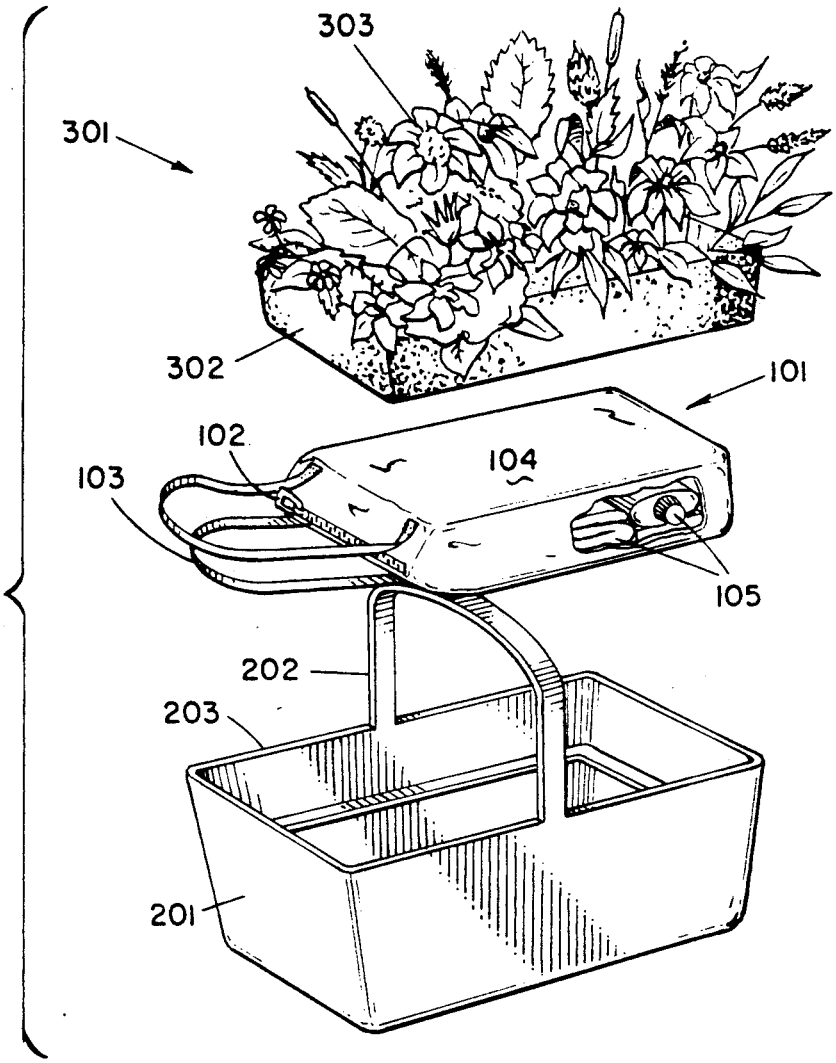
FIG. 1 is an exploded view of one embodiment of a representative storage device of the instant invention.

Referring now to FIG. 1, there is shown an exploded view of a preferred embodiment of the instant invention. In this embodiment, a package 101 is provided. The package 101 is, typically, an assortment of emergency materials which is provided within a plastic bag or similar container. As noted above, the emergency materials 105 (shown in the broken away portion of FIGS. 1 and 2) may comprise medical supplies, bandages, emergency food stuffs and so forth. The contents 105 of the emergency package 104 within the bag or container 104 is not intended to be limitative of the invention. It can be any suitable type of materials required in any particular type of environment.

While the bag 104 or container is, typically, formed of clear plastic for ease in viewing the contents thereof, any other suitable material can be utilized.

In the embodiment shown, the bag 104 has a closure such as a zipper 102 at one end thereof. The other end can be the conventional closed end of a suitable bag or the like. Of course, the bag can be configured so that it folds over on itself, if so desired.

In addition, one or more straps 103 are joined to one end of the bag 101 in a conventional manner. Typically, the straps are joined to the bag adjacent to the open end for convenience. The straps 103 may be additional pieces of plastic. Conversely, the straps can be leather, cord, chain or any other suitable material.

Also shown in FIG. 1 is a receptacle 201 which takes the form of a basket. The basket is of conventional shape and configuration having a closed bottom, side walls and an open top. The basket 201 may include a handle 202 which spans the open end thereof. The basket 201 can be formed of any suitable material such as wicker, bamboo, reeds, cloth, plastic or the like. Moreover, the basket can be formed of a suitable material which can be embossed, textured, treated or otherwise formed to have the appearance of the other types of materials noted above. The basket 201 is configured so as to receive the bag 104 in a relatively horizontal or flat position in the bottom of the basket. The bag 104 need not be precisely coextensive with the inner dimensions of the basket 201. However, a preferred and more aesthetically pleasing arrangement can be achieved by having the bag and basket have complementary dimensions.

Also shown in FIG. 1 is the decorative item 301 which, in this instance, takes the form of a floral arrangement In this case, decorative item 301 includes a base 302 which can be fabricated of a rigid, lightweight, cellular polystyrene (for example manufactured under the trademark STYROFOAM) or any other suitable material. Typically, the base 302 is relatively lightweight so as to not impinge deleteriously on the package 101 in bag 104. In addition, being lightweight, the decorative item can be removed from the receptacle 201 with ease. In addition, a floral arrangement comprising a plurality of components 303 is shown. The components 303 can be leaves, stems, flowers or any other floral arrangement which may be known. Typically, the floral arrangement is formed of artificial flowers such as but not limited to silk flowers, plastic flowers or the like. As noted, the floral components may be flowers, leaves or the like. This selection is not critical to the invention and is left as a design preference. The base 302 serves as a support layer for the other items which are mounted thereto.

Other materials can be used in this regard. For example, the decorative item could be a figure representing an animal or animals (a plurality of fabric kittens) or the like. Again, the decorative item is arranged to fit into the receptacle 201 on top of the emergency bag 101 in such fashion that the base 302 is completely enclosed and surrounded by the receptacle 201. Thus, only the decorative portion 303 extends above the rim 203 of the basket.

In addition, the straps 103 can be arranged to extend outwardly from the receptacle 201 and to extend over the rim 203. In a preferred embodiment, the straps 103 are arranged to fit between the base 302 and the inner surface of basket 201. In addition, the straps 103 can extend over rim 203. However, the decorative item 303 would overlie the straps and, to a large degree, conceal the straps from view.

Figure 2:
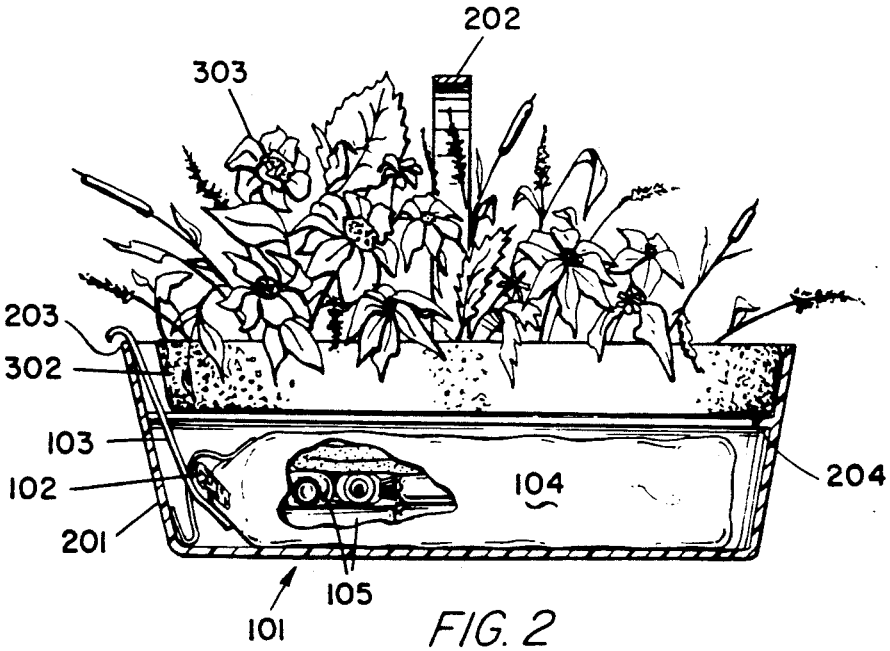
FIG. 2 is a partially broken away view of an assembled embodiment of the instant invention.

Referring now to FIG. 2, there is shown a partially broken away, cross-sectional view of the invention. In this case, the invention is assembled so that the package 101 in bag 104 is nested in and resting upon the inner surface of the bottom of basket 201. The straps 103 of the bag 104 extend upwardly and over lip 203 of the basket. The decorative item 301 rests within the basket 201. As shown, the floral arrangement 303 sits comfortably within the handle 202 although this is not an absolute requirement. Nevertheless, the bottom surface of base 302 of the decorative item rests on the upper surface of bag 101 in the primary embodiment.

It is possible, in an optional arrangement, to include a support ledge 204 at the inner surface of the basket 201. By providing such a ledge, the decorative item 301 can be caused to rest on the ledge and not on the bag 104, if so desired. The support ledge 204 can be formed in the basket, per se, or added as an adjunct thereto.

Thus, there is shown and described a unique design and concept of a decorative storage unit. The particular configuration shown and described herein relates to a plastic bag stored in a receptacle under a decorative unit. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A decorative storage unit comprising, receptacle means, said receptacle means comprises a basket means, package means to be stored within said receptacle means, said package means comprises a container means and at least one useful article stored in said container means for selective use.

said package means includes closure means at one end thereof, at least one strap means which extends outwardly from one end of said container means, a decorative component movably mounted within aid receptacle means and overlying said package means to thereby substantially conceal said package means within said receptacle means, said decorative component includes a support layer and an ornamental layer mounted thereon, said support layer is formed of a cellular polystyrene material, said ornamental layer includes artificial flowers, said strap means extending between and beyond said receptacle means and said decorative component, and bearing means for supporting said decorative component, said bearing means comprises a ledge formed in said receptacle means above said package means.

2. The unit recited in claim 1, wherein, said devices comprise emergency health and medical supplies.

3. The unit recited in claim 1 wherein, said closure means comprises zipper means.

* * * * *